US008533914B2

(12) United States Patent
Vanini

(10) Patent No.: US 8,533,914 B2
(45) Date of Patent: Sep. 17, 2013

(54) HINGE FOR WINGS OR DOORS

(75) Inventor: Angelo Vanini, Bologna (IT)

(73) Assignee: Nuovo Star S.p.A. (IT)

( * ) Notice: Subject to any disclaimer, the term of this patent is extended or adjusted under 35 U.S.C. 154(b) by 248 days.

(21) Appl. No.: 12/153,658

(22) Filed: May 22, 2008

(65) Prior Publication Data

US 2008/0289144 A1 Nov. 27, 2008

(30) Foreign Application Priority Data

May 23, 2007 (IT) ..... BO2007A0369

(51) Int. Cl.
*E05F 1/08* (2006.01)

(52) U.S. Cl.
USPC ..... 16/286; 16/287; 16/50

(58) Field of Classification Search
USPC ..... 16/286, 50, 65, 63, 70, 68, 61, 57, 16/58, 54, 59, 60, 277, 287, 288, 289, 290, 16/296, 302, 304, 306, 366, 368, 369, 370
See application file for complete search history.

(56) References Cited

U.S. PATENT DOCUMENTS

| | | | | |
|---|---|---|---|---|
| 3,712,287 | A * | 1/1973 | Summers, Jr. | 16/289 |
| 3,772,736 | A * | 11/1973 | Hettich et al. | 16/288 |
| 3,818,637 | A | 6/1974 | Vivier | |
| 3,955,865 | A * | 5/1976 | Wilson | 126/191 |
| 4,383,347 | A * | 5/1983 | La Conte | 16/360 |
| 4,422,214 | A * | 12/1983 | Lautenschlager et al. | 16/291 |
| 4,543,686 | A * | 10/1985 | Rock et al. | 16/288 |
| 4,817,240 | A * | 4/1989 | Sovis et al. | 16/297 |
| 5,075,923 | A | 12/1991 | Taylor | |
| 5,269,043 | A * | 12/1993 | Yang | 16/68 |
| 5,704,569 | A * | 1/1998 | Daniels | 244/129.5 |
| 6,684,453 | B2 * | 2/2004 | Wang | 16/54 |
| 6,789,293 | B2 * | 9/2004 | Habegger et al. | 16/343 |
| 7,096,535 | B2 * | 8/2006 | Lin | 16/287 |
| 7,150,071 | B2 * | 12/2006 | Collene et al. | 16/289 |
| 7,600,295 | B2 * | 10/2009 | Zimmer | 16/286 |
| 7,610,656 | B2 * | 11/2009 | Vanini | 16/286 |
| 7,676,888 | B2 * | 3/2010 | Vanini | 16/286 |
| 7,748,080 | B2 | 7/2010 | Hottmann | |
| 2003/0200625 | A1 * | 10/2003 | Zimmer | 16/306 |
| 2004/0040118 | A1 * | 3/2004 | Han et al. | 16/277 |
| 2004/0205935 | A1 | 10/2004 | Lautenschlaeger et al. | |
| 2005/0015927 | A1 * | 1/2005 | Kropf | 16/286 |
| 2005/0155180 | A1 * | 7/2005 | Lin | 16/287 |

(Continued)

FOREIGN PATENT DOCUMENTS

| | | |
|---|---|---|
| AT | 9711 | 2/2008 |
| DE | 41 00 877 A1 | 7/1992 |

(Continued)

OTHER PUBLICATIONS

Italian Search Report dated Mar. 25, 2010 from related Italian patent application—U.S. Appl. No. 12/153,658.

*Primary Examiner* — Jeffrey O Brien
(74) *Attorney, Agent, or Firm* — Timothy J. Klima; Shuttleworth & Ingersoll, PLC

(57) ABSTRACT

The hinge for wings or doors, in particular of electrical appliances, comprises a first box-shaped body, a second box-shaped body, a connecting element between the first and second bodies, and a damper cylinder for applying on the second body an action damping its movement towards the first body.

13 Claims, 5 Drawing Sheets

(56) References Cited

U.S. PATENT DOCUMENTS

| | | | | |
|---|---|---|---|---|
| 2007/0283532 | A1* | 12/2007 | Vanini | 16/277 |
| 2008/0168618 | A1 | 7/2008 | Hottmann | |
| 2010/0101052 | A1 | 4/2010 | Waltemate et al. | |
| 2011/0283478 | A1 | 11/2011 | Berry et al. | |

FOREIGN PATENT DOCUMENTS

| | | | |
|---|---|---|---|
| DE | 19522254 | | 1/1997 |
| EP | 50320 | A1 * | 4/1982 |
| EP | 1 217 159 | A2 | 6/2002 |
| EP | 1884614 | | 2/2008 |
| WO | 2008119647 | | 10/2008 |

* cited by examiner 4
5
6
7
8
9
11
12
13
13a
13b
15
16
17
18
19
20'
20'a
20'b
21
24
24-25
25
B

HINGE FOR WINGS OR DOORS

BACKGROUND OF THE INVENTION

The present invention relates to a hinge for wings or doors, and in particular to a hinge designed to connect doors of electrical appliances, such as ovens, to the respective supporting frame.

In the following description and by way of example only, without limiting the scope of the invention, the present invention is described with reference to an oven.

Hinges of this type normally consist of two separate parts, kinematically connected to one another, directly or by inserting a lever or the like between them.

In known types of ovens hinges usually comprise two separate elements, kinematically connected to one another and both having a box-shaped structure. More precisely, one of the two box-shaped structures is fixed to the oven frame, at one side of the oven mouth, whilst the other box-shaped structure is fixed to one edge of the door, which in that way is rendered movable with a tilting action relative to the above-mentioned frame.

Between the two box-shaped structures a lever element is operatively inserted as a connecting element, the lever element pivoting on one of the two box-shaped structures, usually on the one stably fixed to the door, and having a first arm rigidly connected to the other of the two box-shaped structures. The second arm of the lever element, coplanar with the first, is operated on by elastic elements which influence the movement of the door, for both opening and closing.

During door rotation starting from the closed position, the elastic elements oppose, during a first step, the detachment of the door from the oven supporting frame and, in a second step, subsequent rotation of the door and its consequent lowering to an end of stroke position in which the oven mouth is completely open. In this second opening step, the door, under the combined action of its own weight which promotes its descent and of the elastic elements which apply a braking action, performs a gradual rotation.

During door rotation starting from its open end of stroke position, the action of the elastic elements is first balanced by the weight of the door, initially guaranteeing gradual closing rotation; however, then, in the absence of a suitable braking action by the user, the elastic elements push the door towards the oven frame with such a force that it often closes in a rather sudden and noisy way.

SUMMARY OF THE INVENTION

The present invention has for an aim to provide a hinge for wings or doors which is free of the above-mentioned disadvantage and which at the same time has a simple structure and practical and effective operation.

The technical features of the present invention, in accordance with the above aim, are clear from the content of the claims herein, in particular claim 1 and, preferably, from any of the claims directly or indirectly dependent on claim 1.

BRIEF DESCRIPTION OF THE DRAWINGS

The advantages of the present invention are more apparent in the detailed description which follows, with reference to the accompanying drawings which illustrate preferred, non-limiting embodiments of the invention, in which.

DESCRIPTION OF THE PREFERRED EMBODIMENTS

Figure 1:
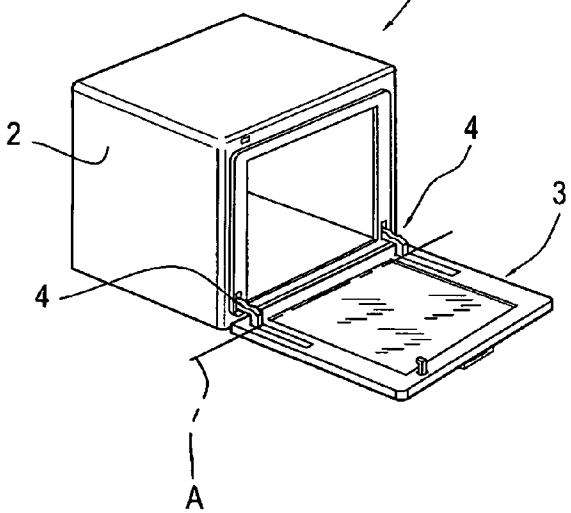
FIG. 1 is a schematic perspective top view of an oven fitted with a door which is connected to it by two hinges made in accordance with the present invention.

With reference to FIG. 1, the numeral 1 denotes as a whole an oven comprising a frame 2 to which a door 3 is connected by two hinges 4, which allow the door to rotate with a tilting action about a horizontal axis A.

Figure 2:
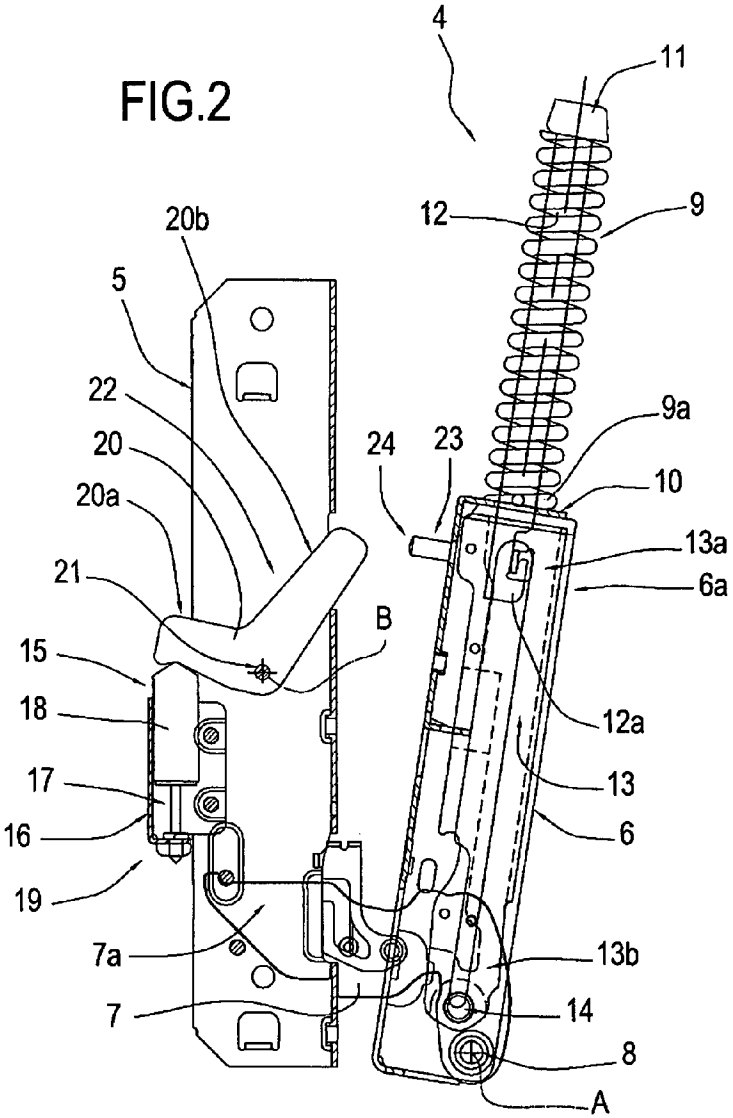
FIGS. 2 to 4 are respective side elevation views with some parts in cross-section and others transparent, of a first embodiment of the hinge for wings or doors in accordance with the present invention, in its three different operating steps.
Figure 4:
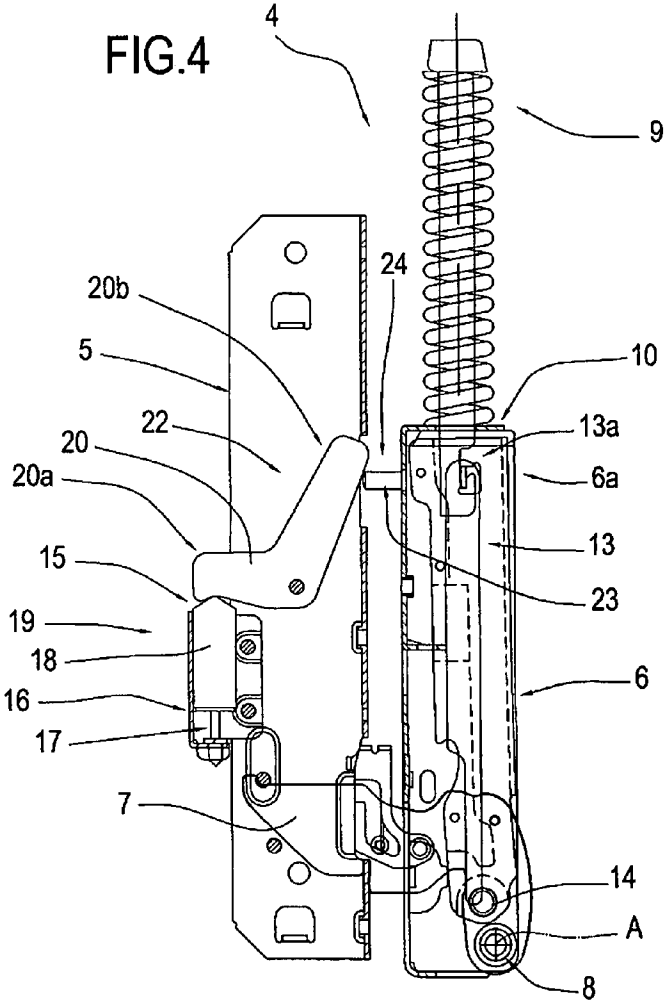
Figure 3:
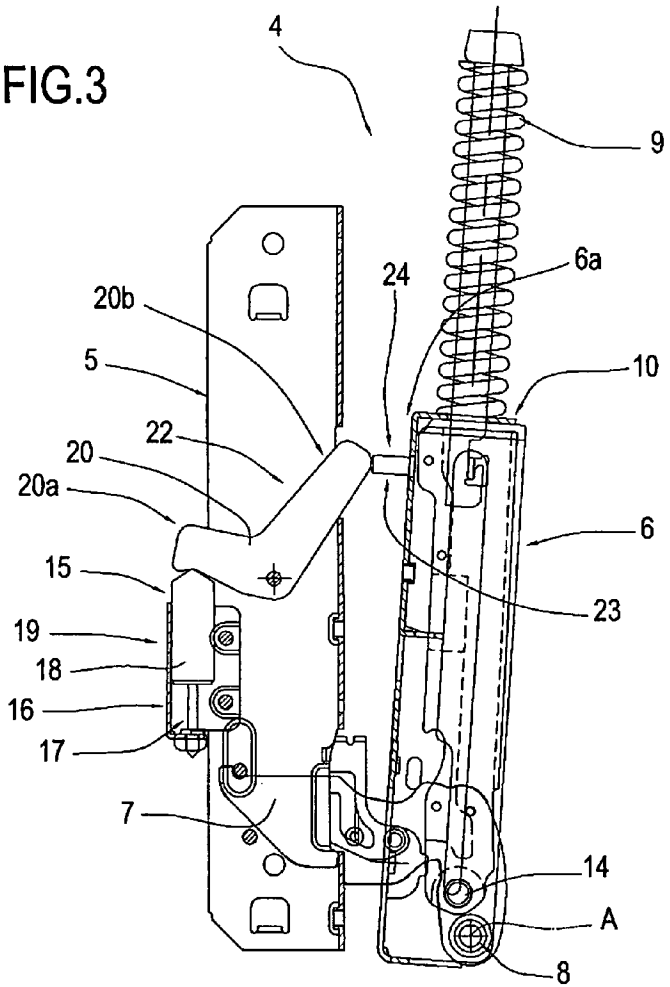

FIGS. 2 to 4 illustrate a first embodiment of a hinge 4 made in accordance with the present invention.

Each of the two hinges 4 comprises a first box-shaped body 5, fixed to the oven 1 frame 2 at a respective side of the oven mouth, and a second box-shaped body 6, fixed to a respective edge of the door 3.

Both of the box-shaped bodies 5 and 6 have an extended shape and they are kinematically connected to one another by a connecting element 7, which is also part of the hinge 4. The connecting element 7 pivots on the second box-shaped body 6 by means of a pin 8 and has a portion 7*a* rigidly connected to the first body 5 to render the door 3 movable with a tilting action relative to the frame 2 between a closed limit position, illustrated in FIG. 4, and an open limit position, not illustrated. For a better understanding of the invention, illustrations of door 3 and hinge 4 partially open positions are useful, for example the configurations illustrated in FIGS. 2 and 3.

The hinge 4 also comprises a helical spring 9 fitted on the outside of the second box-shaped body 6. The lower end coil 9*a* of the spring 9 is in contact with a transversal wall 10 of the second box-shaped body 6.

The spring 9 is held in contact with said transversal wall 10 by the head 11 of a bar 12 positioned coaxially inside the spring 9 and which forms a guide for the spring 9.

One end 12*a* of the bar 12 exits the bottom of the spring 9 and passes through an opening made in the transversal wall 10 and hooks onto a first longitudinal end 13*a* of a tension rod 13, whose second longitudinal end 13*b* is hinged to the connecting element 7 by a pin 14 positioned close to the above-mentioned pin 8.

The position of the pin 14, where the elastic reaction force of the spring 9 is applied, relative to the pin 8, and the pre-compression of the spring 9, guarantee an elastic action which tends to continuously push and hold the door 3 in its closed position.

As illustrated in FIGS. 2 to 4, the hinge 4 comprises a gas or fluid damper cylinder 15 supported by a respective supporting plate 16 fixed cantilever-style on the first box-shaped body 5.

In the particular, non-limiting embodiment illustrated in FIGS. 2 to 4, the cylinder 15 comprises a fixed rod 17, integral with the plate 16, and a body 18 which can move relative to the rod 17.

Irrespective of whether it is of the type using gas or fluid, the damper cylinder 15 forms for the hinge 4 respective damping means 19 which, as explained in more detail below, are designed to apply on the second box-shaped body 6 an action damping its movement towards the first box-shaped body 5, as the door 3 passes from an open position to the above-mentioned closed position.

The hinge 4 also comprises a rocker lever 20, pivoting on the first box-shaped body 5 by means of a relative pin 21, so that it can rotate about its own pivoting axis B, perpendicular to the plane of FIGS. 2 to 4.

On opposite sides of the pin 21, the lever 20 has a first and a second arm, respectively labeled 20*a* and 20*b*.

The first arm 20*a* of the lever 20 is designed to engage with the damper cylinder 15, to press the movable body 18 against the rod 17.

The lever 20 forms, for the hinge 4, respective means 22 for operating the damping means 19.

As illustrated in FIGS. 2 to 4, close to its upper zone 6*a*, the second box-shaped body 6 has a projecting peg 23, extending towards the first box-shaped body 5.

The projecting peg 23 constitutes a control element 24 for the rocker lever 20. As described in more detail below, the element 24 is designed to engage with the second arm 20*b* of the lever 20 to make the lever rotate about its pivoting axis B.

The following is a brief description of the operation of one of the hinges 4 illustrated in FIGS. 2 to 4, starting from a door 3 open position.

Starting from the door 3 fully open position, not illustrated, a rotation of the door and of the second box-shaped body 6 about the axis A towards the closed position is promoted by the elastic action of the spring 9 and is initially hindered by the weight of the door 3.

With the second box-shaped body 6 in the position illustrated in FIG. 2, the elastic reaction force of the spring 9, overcoming the weight, should push the door 3 to close quickly, the door in the meantime having reached a predetermined speed.

Operation of the spring 9, compressed by the movement of the second box-shaped body 6 due to the pulling action applied by the tension rod 13 and by the bar 12 connected to it, is substantially known and therefore is not described in detail in this text.

As the door 3 closing movement continues, the second box-shaped body 6 of the hinge 4 reaches the position illustrated in FIG. 3, where the projecting peg 23 constituting the control element 24 makes contact with the second arm 20*b* of the rocker lever 20.

As the door 3 passes between the still partly open position illustrated in FIG. 3 and the closed position shown in FIG. 4, the damping means 19, following damper cylinder 15 compression, apply a damping action conflicting with the closing action applied by the spring 9, therefore making door 3 movement towards the fully closed position gradual and subject to a braking action.

In detail, with reference to FIGS. 3 and 4, the projecting peg 23, integral with the second box-shaped body 6, pushing the second arm 20*b* of the lever 20, causes the lever 20 to rotate anti-clockwise about its pivoting axis B. Said rotation of the lever 20 results in its first arm 20*a* in turn pushing the movable body 15 against the fixed rod 17, compressing the damper cylinder 15.

It is therefore evident that, even in the absence of a braking action by the user, the door 3, pushed towards the oven 1 frame 2 by the spring 9, reaches the frame in a gentle, silent way thanks to the end of stroke damping provided by the damping means 19.

Figures 5, 6, 7:
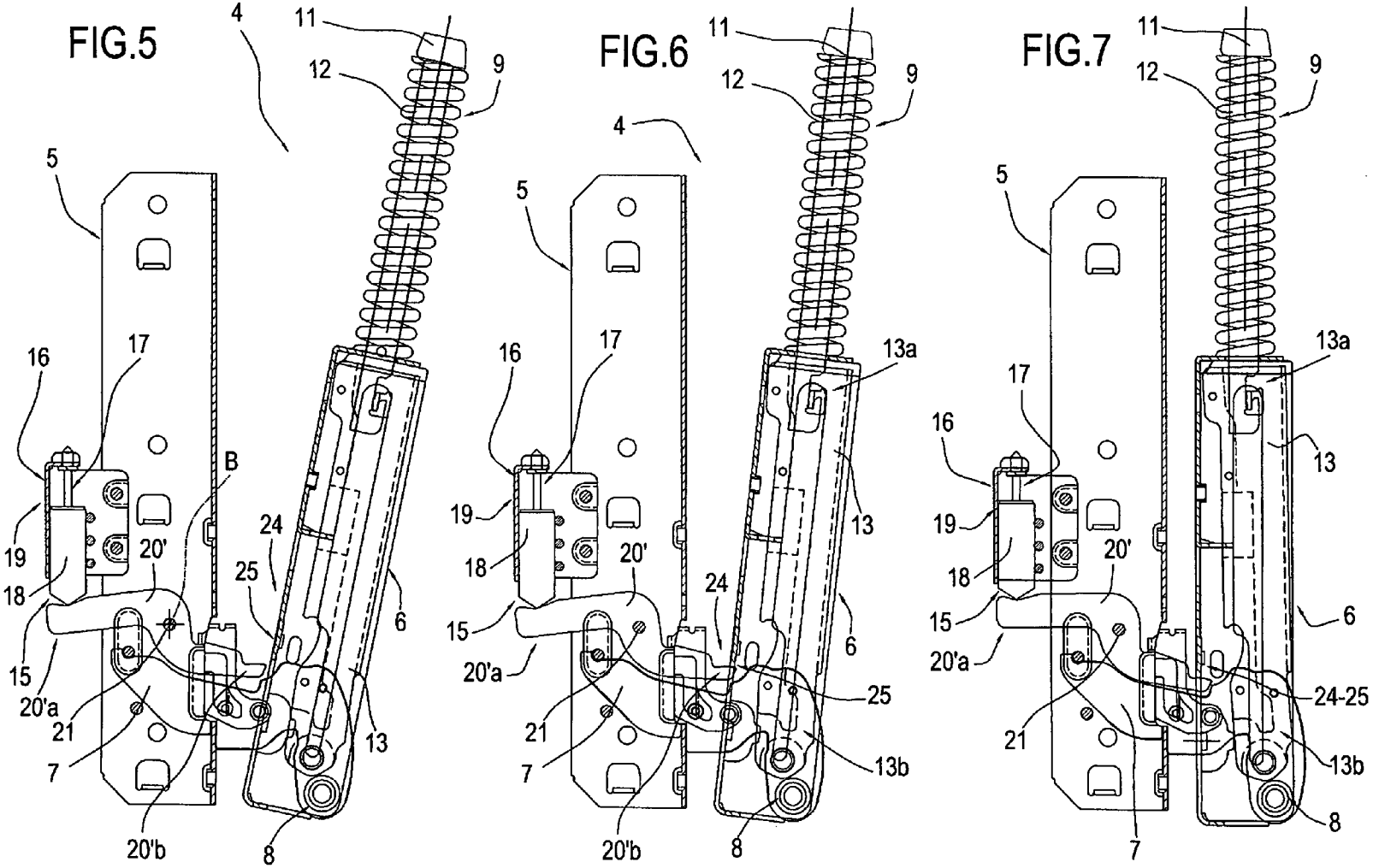
FIGS. 5 to 7 are respective side elevation views with some parts in cross-section and others transparent, of a second embodiment of the hinge for wings or doors in accordance with the present invention, in its three different operating steps.

FIGS. 5 to 7 illustrate a second embodiment of a hinge 4 made in accordance with the present invention.

In terms of the structural parts of which the hinge 4 in FIGS. 5 to 7 consists, it differs from the hinge described above and illustrated in FIGS. 2 to 4 only in the different shape of the means 22 for operating the damping means 19, the relative control element 24 and the different positioning of the damper cylinder 15.

In detail, with reference to FIGS. 5 to 7, in its second embodiment illustrated, the hinge 4 comprises a rocker lever 20', pivoting on the first box-shaped body 5 by means of a relative pin 21, so that it can rotate about its own pivoting axis B.

In the assembled hinge 4, the rocker lever 20' is positioned close to the connecting element 7 between the two box-shaped bodies 5, 6.

On opposite sides of the pin 21, the lever 20' has a first and a second arm, respectively labeled 20'*a* and 20'*b*.

The first arm 20'*a* of the lever 20' is designed to engage with the damper cylinder 15, to press the movable body 18 against the rod 17.

The lever 20' forms, for the hinge 4, respective means 22 for operating the damping means 19.

As illustrated in FIG. 5, the control element 24 consists of a wall 25 of the second box-shaped body 6 which is designed to engage, edgeways, with the second arm 20'*b* of the lever 20.

Similarly to what is described above for the first embodiment of the hinge 4, hereinafter there is a brief description of operation of the hinge 4 illustrated in FIGS. 5 to 7, starting from a door 3 open position.

Starting from the door 3 fully open position, not illustrated, a rotation of the door and of the second box-shaped body 6 about the axis A towards the closed position is promoted by the elastic action of the spring 9 and is initially hindered by the weight of the door 3.

As the door 3 closing movement continues, the second box-shaped body 6 of the hinge 4 reaches the position illustrated in FIG. 6, where the wall 25 constituting the control element 24 makes contact with the second arm 20'*b* of the rocker lever 20'.

As the door 3 passes between the still partly open position illustrated in FIG. 6 and the closed position shown in FIG. 7, the damping means 19, following damper cylinder 15 compression, apply a damping action conflicting with the closing action applied by the spring 9, therefore making door 3 movement towards the fully closed position gradual and subject to a braking action.

In detail, with reference to FIGS. 6 and 7, the wall 25 of the second box-shaped body 6, pushing the second arm 20'*b* of the lever 20, causes the lever 20 to rotate clockwise about its pivoting axis B. Said rotation of the lever 20' results in its first arm 20'*a* in turn pushing the movable body 15 against the fixed rod 17, compressing the damper cylinder 15.

As already indicated relative to the first embodiment of the hinge 4, again for the second embodiment illustrated in FIGS. 5 to 7, it is evident that, even in the absence of a braking action by the user, the door 3, pushed by the spring 9 towards the oven 1 frame 2, reaches the frame in a gentle, silent way thanks to the end of stroke damping provided by the damping means 19.

Figure 8:
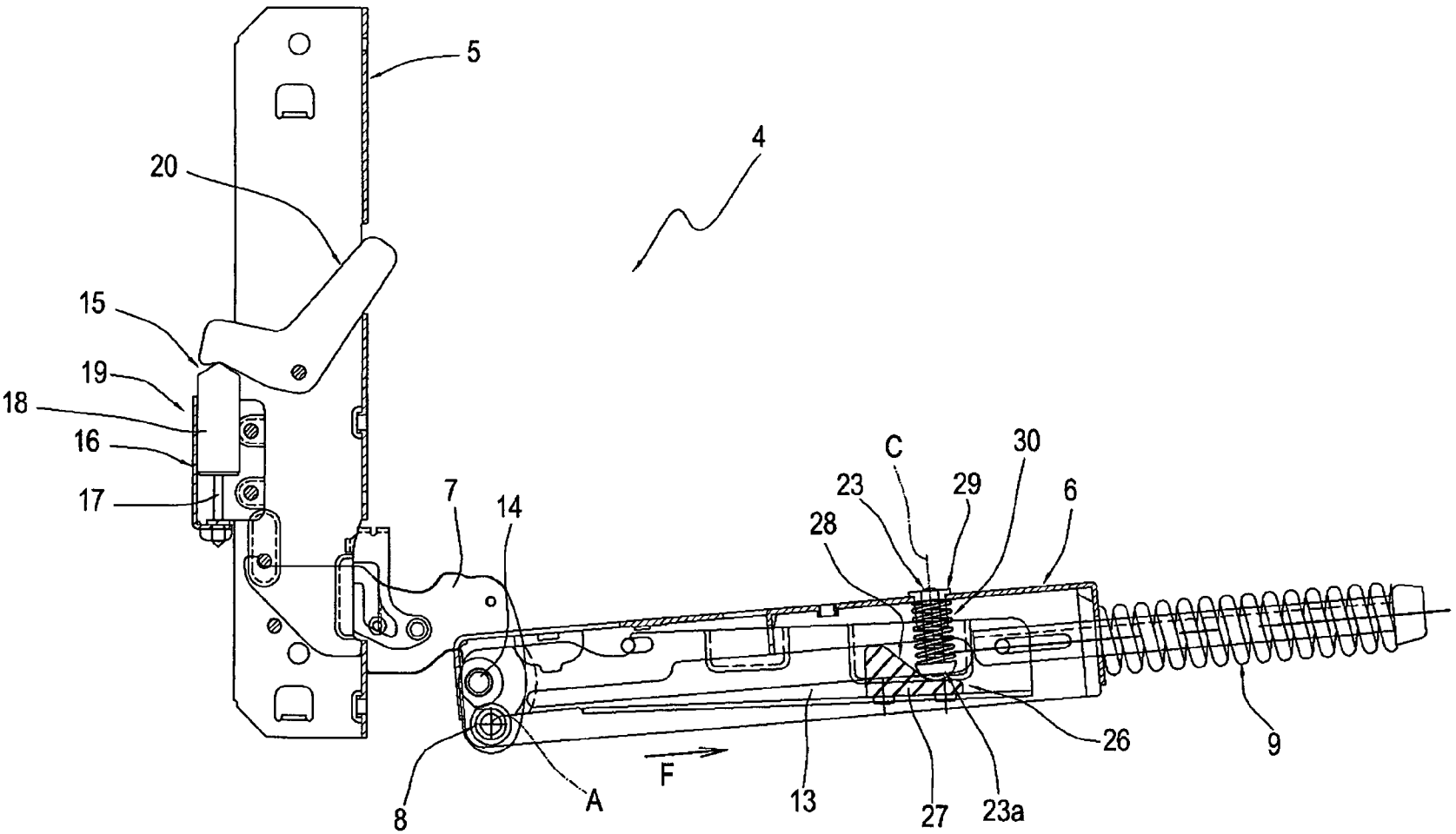
FIGS. 8 to 10 are respective side elevation views with some parts in cross-section and others transparent, of a third embodiment of the hinge for wings or doors in accordance with the present invention, in its three different operating steps.
Figure 10:
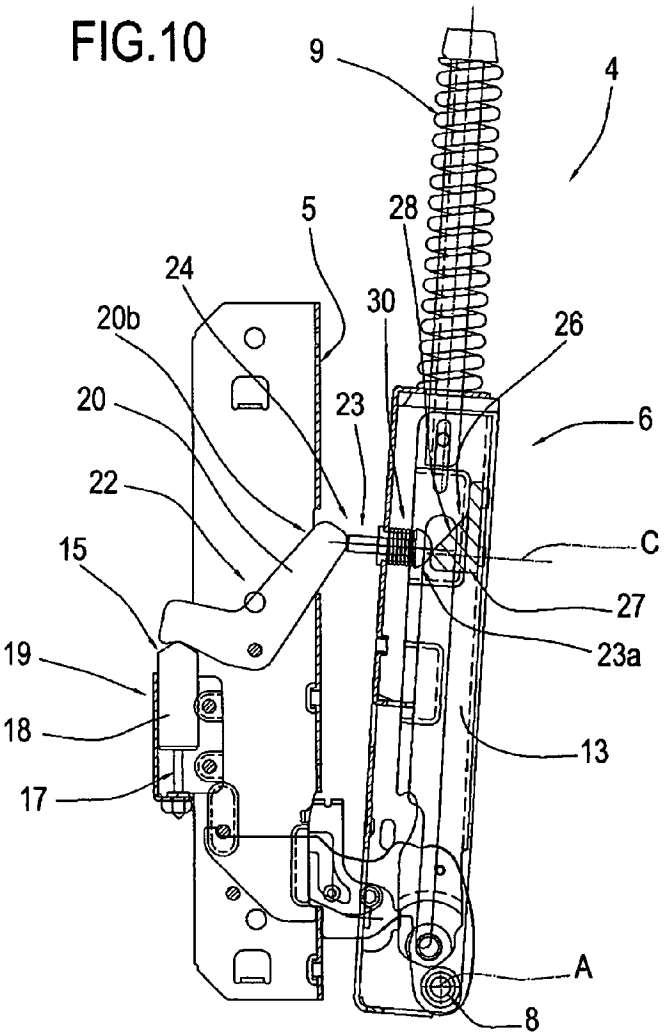
Figure 9:
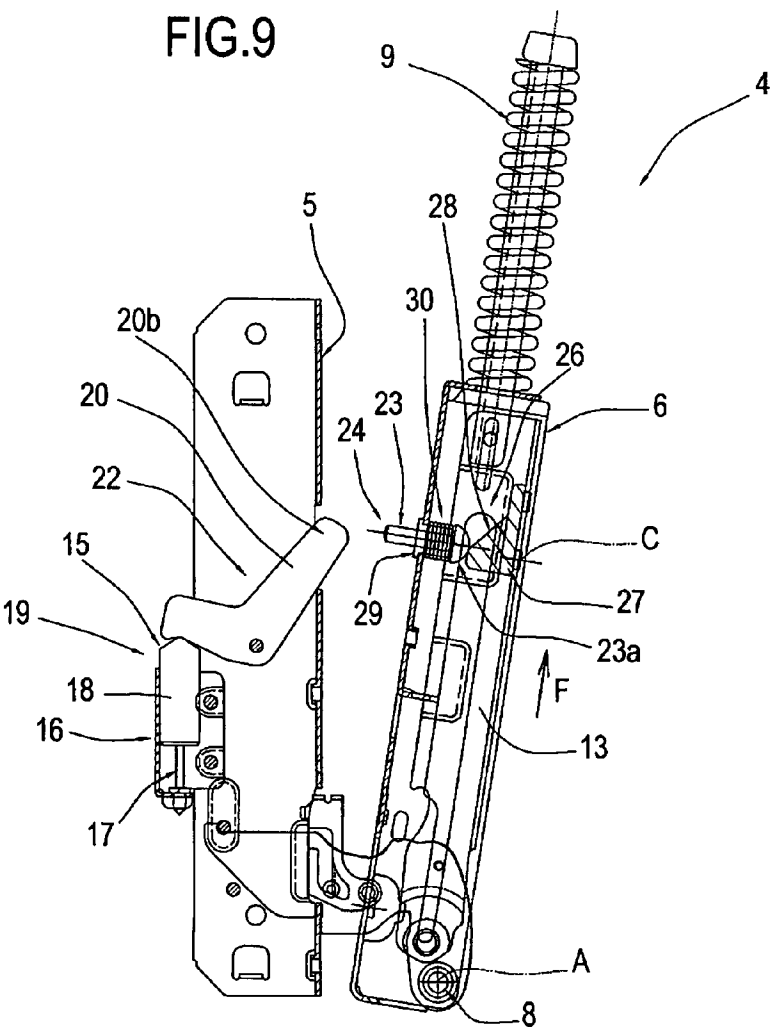

FIGS. 8 to 10 illustrate a third embodiment of a hinge 4 made in accordance with the present invention.

In terms of the structural parts of which the hinge 4 in FIGS. 8 to 10 consists, it differs from the hinge described above and illustrated in FIGS. 2 to 4 only in the presence of a device 26 for moving the peg 23, the device 26 being designed to move the peg 23 forward and backward depending on the different door 3 closing or opening steps.

The movement device 26 comprises a slide 27 integral with the tension rod 13. The slide 27 comprises a cam profile 28 against which a peg 23 inner head 23*a* is designed to slidably engage.

The peg 23 slidably engages in a cylindrical bushing 29, fixed to the second box-shaped body 6, and a helical spring 30 is inserted between the bushing 29 and the head 23*a* of the peg 23 to apply an elastic force opposing movement of the head 23*a* towards the bushing 29.

In practice, starting from the door 3 and second box-shaped body 6 fully open position, illustrated in FIG. 8, a rotation by both about the axis A towards the closed position is promoted by the elastic action of the spring 9 and is initially hindered by the weight of the door 3.

With the second box-shaped body 6 in the position illustrated in FIG. 8, the peg 23 is in its first, back non-operating configuration. In other words, the peg 23 is practically housed inside the space delimited by the second box-shaped body 6.

As the door 3 closing movement continues, with the rotation of the second box-shaped body 6 about its axis A, there is a relative movement between the tension rod 13 and the second box-shaped body 6. Said relative movement causes the slide 27 to slide in the direction indicated by the arrow F in FIG. 9.

The movement of the slide 27, as a result of contact between the slide 27 cam profile 28 and the head 23*a* of the peg 23, causes the peg 23 to move in the direction of its own axis C, until it exits the second box-shaped body 6, as illustrated in FIGS. 9 and 10.

As illustrated in FIG. 10, during the door 3 closing step, the peg 23 stably adopts its second, forward operating configuration in which, acting as the control element 24, it can engage with and push the rocker lever 20, similarly to what was described above with reference to the hinge 4 illustrated in FIGS. 2 to 4.

In its movement between the first, back configuration and the second, forward configuration, the peg 23 slides inside the bushing 29 and is opposed by the opposing action of the spring 30.

When the door 3 is opened, that is to say, when passing between the second, forward configuration and the first, back configuration, the spring 30 pushes the peg 23 back into the second box-shaped body 6.

Relative to all three embodiments of the hinge 4 described above, it must also be emphasized that the damping means 19 are supported by the first box-shaped body 5 and therefore are housed embedded in the electrical appliance frame 2, in a position that is hidden from view and which is protected from knocks or dirt, with obvious advantages in terms of appearance and reliable operation.

Moreover, advantageously, thanks to their position in the frame 2 of the electrical appliance, when this is an oven, the damping means 19 are also better protected from heat than they would be if they were contained in the door 3.

Protection from the heat of the oven allows the life of the damping means 19 to be extended. If they were not protected in this way, their shock absorbing capacity would deteriorate rapidly.

The control element 24 was described and illustrated as a peg or a wall of the box-shaped body, but it shall be understood that such embodiments are provided by way of example only and are non-limiting, since it could be made in any shape and size.

According to alternative embodiments of the present invention, not illustrated, there are elements for limiting friction, such as rollers or wheels, inserted between the control element and the rocker lever forming the means for operating the damping means.

What is claimed is:

1. A hinge, comprising:

a first box-shaped body for fixing to a frame;

a second box-shaped body for fixing to a door;

a connecting mechanism between the box -shaped bodies, for rendering the door movable with a tilting action relative to the frame between a closed position and at least one open position;

a damping mechanism, supported by the first body, for applying a damping force on the second body damping movement of the second body towards the first body, when the closed position is almost reached; and a mechanism for controlling operation of the damping mechanism, the mechanism for controlling operation attached to the second box-shaped body, the mechanism for controlling operation spaced apart from the damping mechanism in a non-engaging manner when in the open position, the mechanism for controlling operation first coming into operative engagement with the damping mechanism only when the closed position is almost reached and from that position of first operative engagement until the closed position, operatively engaging the damping mechanism in such a manner that a compression of the damping mechanism continuously increases between the position of first operative engagement and the closed position;

a mechanism for operating the damping mechanism, the mechanism for operating the damping mechanism being operatively positioned between the mechanism for controlling operation and the damping mechanism;

wherein the mechanism for operating the damping mechanism comprises a rocker lever pivoting on the first box-shaped body.

2. The hinge according to claim 1, wherein the mechanism for controlling operation engages the rocker lever at the position of first operative engagement, causing the rocker lever to rotate about its own pivoting axis.

3. The hinge according to claim 2, wherein the rocker lever comprises a first arm for engaging the damper cylinder, and a second arm for engaging the mechanism for controlling operation.

4. The hinge according to claim 2, wherein the mechanism for controlling operation includes a peg projecting from the second box-shaped body.

5. The hinge according to claim 4, wherein the peg can move at least between a first, back non-operating configuration and a second, forward operating configuration.

6. The hinge according to claim 5, further comprising a device for moving the peg between its two configurations, back and forward.

7. The hinge according to claim 6, wherein the movement device comprises a slide having a cam profile designed to push the peg.

8. The hinge according to claim 7, wherein the movement device comprises a spring opposing the movement of the peg.

9. The hinge according to claim 2, wherein the mechanism for controlling operation includes a wall of the second box-shaped body.

10. The hinge according to claim 1, further comprising a plate for supporting the damper cylinder, the plate being fixed cantilever-style on the first box-shaped body.

11. An electrical appliance comprising at least one hinge according to claim 1.

12. The hinge according to claim 3, wherein the mechanism for controlling operation includes a peg projecting from the second box-shaped body.

13. The hinge according to claim 3, wherein the mechanism for controlling operation includes a wall of the second box-shaped body.

* * * * *

UNITED STATES PATENT AND TRADEMARK OFFICE

CERTIFICATE OF CORRECTION

PATENT NO. : 8,533,914 B2
APPLICATION NO. : 12/153658
DATED : September 17, 2013
INVENTOR(S) : Vanini It is certified that error appears in the above-identified patent and that said Letters Patent is hereby corrected as shown below:

The Title page, Item no. (73) Should read as follows:

Nuova Star S.p.A.

Signed and Sealed this
Eleventh Day of February, 2014

Michelle K. Lee

Michelle K. Lee
*Deputy Director of the United States Patent and Trademark Office*